United States Patent [19]

Gaulard

[11] Patent Number: 4,880,048

[45] Date of Patent: Nov. 14, 1989

[54] APPARATUS FOR THE MOULDING OF A CYLINDER BLOCK OR OF A CORRESPONDING FOUNDRY PATTERN

[75] Inventor: Michel Gaulard, Montbeliard, France

[73] Assignees: Automobiles Peugeot, Paris; Automobiles Citroen, Neuilly/Seine, both of France

[21] Appl. No.: 242,167

[22] Filed: Sep. 8, 1988

[30] Foreign Application Priority Data

Sep. 10, 1987 [FR] France ..... 87 12569

[51] Int. Cl.[4] ..... B22D 17/26

[52] U.S. Cl. ..... 164/342; 164/45; 249/64; 249/152; 249/176; 249/180; 249/184; 425/577; 425/DIG. 5; 425/DIG. 58

[58] Field of Search ..... 164/45, 245, 246, 341, 164/342, 343; 249/63, 64, 152, 176, 180, 184; 425/577, DIG. 5, DIG. 58

[56] References Cited

U.S. PATENT DOCUMENTS

| | | | |
|---|---|---|---|
| 2,824,347 | 2/1958 | Winship et al. | 164/344 |
| 2,965,938 | 12/1960 | Davis | 164/340 |
| 3,897,816 | 8/1975 | Nishiyama et al. | 164/230 |
| 4,533,312 | 8/1965 | Von Holdt | 249/160 |
| 4,576,568 | 3/1986 | Grannen, III | 425/DIG. 5 |
| 4,632,169 | 12/1986 | Osborn et al. | 164/45 |

FOREIGN PATENT DOCUMENTS

| | | | |
|---|---|---|---|
| 0070763 | 1/1983 | European Pat. Off. . | |
| 1113726 | 9/1961 | Fed. Rep. of Germany . | |
| 2479044 | 10/1981 | France . | |
| 54-133554 | 10/1979 | Japan | 249/160 |
| 935209 | 6/1982 | U.S.S.R. | 164/342 |

*Primary Examiner*—Richard K. Seidel

*Attorney, Agent, or Firm*—Burns, Doane, Swecker & Mathis

[57] ABSTRACT

Cylinder block molding apparatus includes two series of parallel and alternate molding plates for partitions. The plates extend in planes perpendicular to the axis of an engine shaft. Each series of molding plates is mounted, respectively, on a support capable of sliding parallel to the axis of the engine shaft relative to the cylinder block between a molding position where mutually confronting molding faces of two consecutive plates bear against one another and a lifting position where the molding faces are moved apart as a result of sliding of the supports.

6 Claims, 6 Drawing Sheets

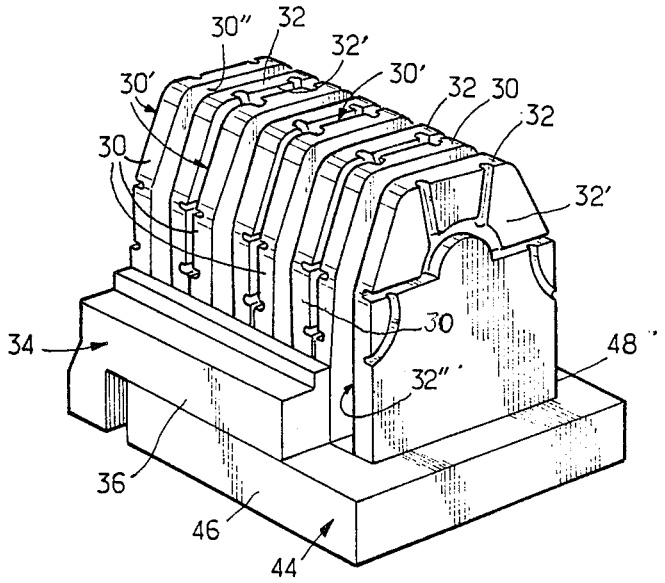
FIG. 3
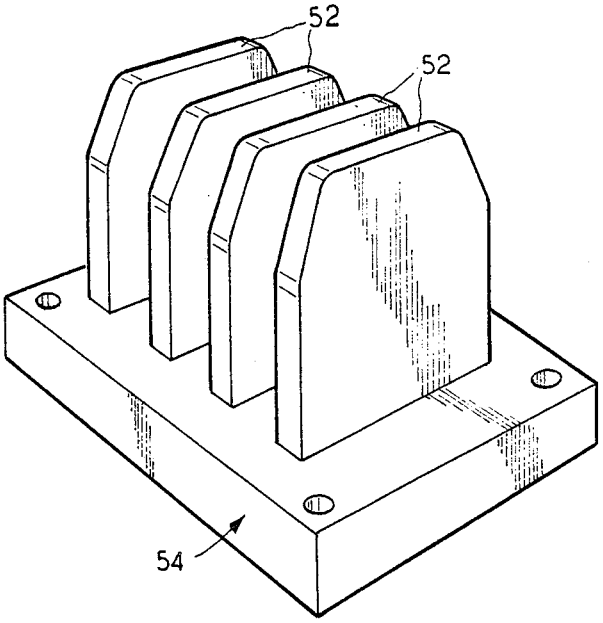

APPARATUS FOR THE MOULDING OF A CYLINDER BLOCK OR OF A CORRESPONDING FOUNDRY PATTERN

The present invention relates to an apparatus for the moulding of an internal-combustion engine housing or cylinder block comprising several aligned cylinders of parallel axes and several bearings for the mounting of a rotary shaft, for example the engine crankshaft, the axis of which is perpendicular to the axis of the cylinders and which is carried respectively by several parallel partitions which extend in planes perpendicular relative to the axis of the shaft and which have recesses preventing the cylinder block from being lifted in a direction parallel to the axis of the cylinders.

The moulding apparatus can also be used for producing a corresponding foundry pattern, for example a foam pattern used in the technique of moulding with waste foam, known as the lost-foam technique.

The production of a cylinder block by moulding in a casting dye by gravity and low pressure or the lost-foam production of a corresponding pattern, of which the walls serving as a support for the crankshaft bearings have recesses which do not lift, can be carried out by various techniques.

It is possible, for example, to produce a pattern of the cylinder block with sleeves joined together by adhesive bonding. The recesses in the upper part of the bearings are obtained from the water box of the cylinder block. The disadvantage of this technique is that it is necessary to join elements together, thus giving rise to leaks and cracks in the water box. Furthermore, the bearings are recessed from the lateral faces, and this presents cleaning difficulties. Besides, the cylinder blick thus obtained is not very aesthetic in view of current requirements which tend to reduce to a minimum the cells in the outer wall of the cylinder block. This solution also gives rise to a loss of rigidity of the cylinder block and to problems in the machining of the bearing; the cost of the patterns to be produced in order to put it into practice is also very high.

According to another technique, it is known to produce a pattern of the cylinder block, to which the bearings are attached by adhesive bonding or by assembling together. This technique makes it necessary to carry out a difficult assembly of the various components of the housing with great accuracy, and this usually gives rise to numerous defects in the connection zone of the various elements. It makes it necessary to use additional mould elements, the cost of which is likewise very high. The disadvantages of this solution are encountered again in an equivalent technique which involves producing a pattern of the cylinder block which is cut into two parts in the region of the upper part of the bearings.

The different techniques of lost-foam moulding for obtaining cast-iron or aluminum components, which have just been mentioned, make it necessary to conduct specific endurance tests and trials because of their differences in design and geometry in relation to components obtained by a conventional sand-moulding process. The object of the invention is to provide a moulding apparatus which makes it possible, where lost-foam moulding or casting-die moulding are concerned, to obtain components identical to those obtained by means of the conventional sand-moulding process.

According to the invention, the moulding apparatus is characterized in that it possesses, for the moulding of the partitions, two series of parallel and alternate moulding plates which extend in planes perpendicular relative to the axis of the shaft, each series of moulding plates being mounted respectively on a support which is capable of sliding parallel to the axis of the shaft in relation to the cylinder block between a moulding position, in which the mutually confronting moulding faces of two consecutive plates bear against one another, and a lifting position, in which these moulding faces are moved apart from one another as a result of the relative sliding of the two supports.

According to another characteristic of the invention, the moulding apparatus possesses a series of clamping elements mounted on a platform which can slide perpendicularly relative to the axis of the shaft between its moulding position, in which each clamping element is received between the said bearing faces, and its lifting position, in which the clamping elements are retracted in order to allow the sliding of the supports.

According to an especially advantageous embodiment of the invention, each of the two supports is formed from a frame comprising two lateral columns, between which the moulding plates are mounted spaced from one another, the two frames being superposed and sliding on one another.

Other characteristics and advantages of the invention will emerge from a reading of the following detailed description, for the understanding of which reference will be made to the accompanying drawings in which:

FIG. 3 is a simplified diagrammatic perspective view of the main movable elements of the moulding apparatus illustrated in FIGS. 1 and 2;

Figure 1:
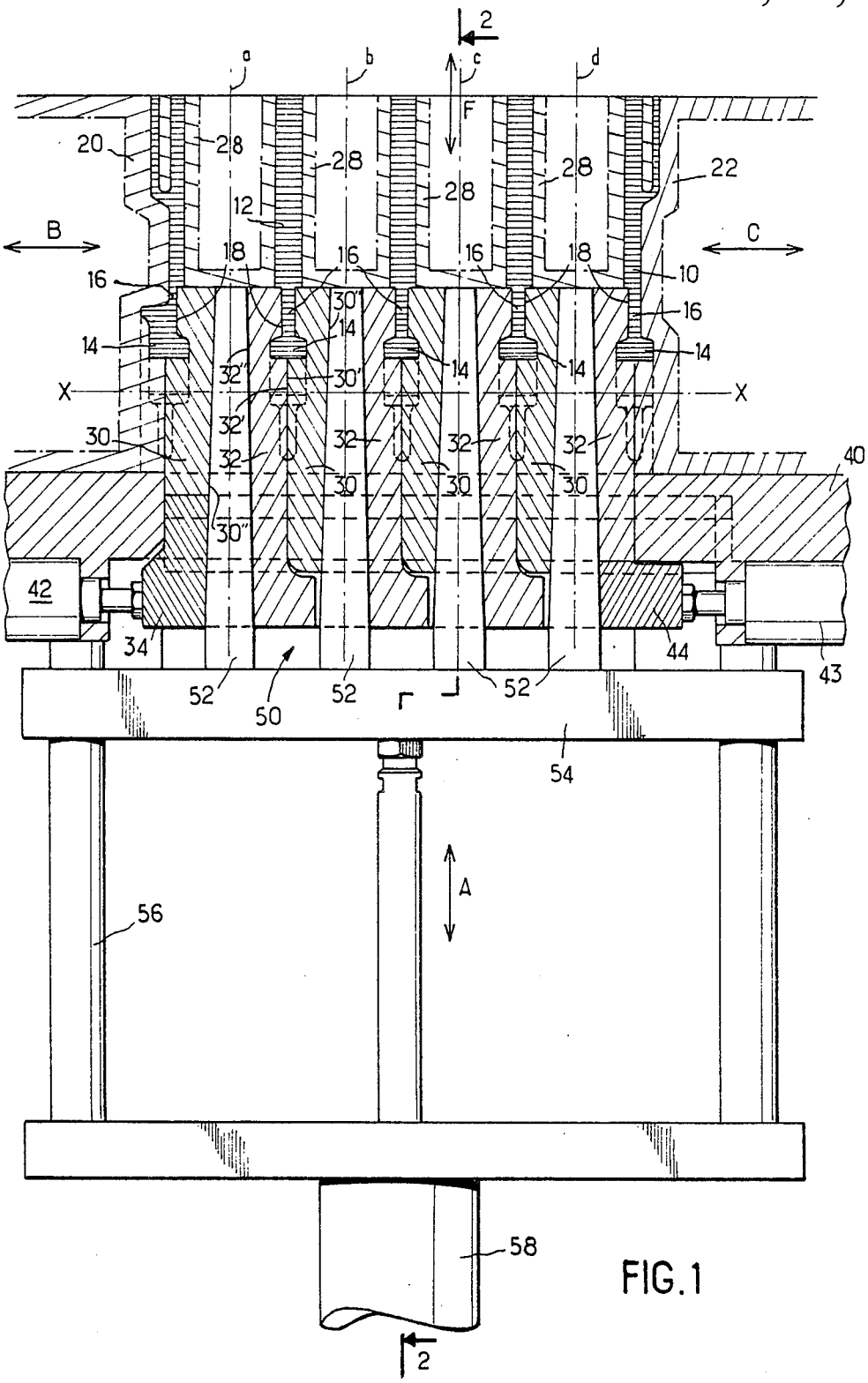
FIG. 1 is a view in axial section, along the line 1—1 of FIG. 2, of a moulding apparatus produced according to the teaching of the invention and shown in its closed moulding position.

The object of the moulding apparatus according to the invention, illustrated in the Figures, is to make it possible to produce a cylinder block 10 or a corresponding foundry pattern.

The cylinder block 10 comprises, in its upper part, several aligned cylinders of parallel axes 12. In an embodiment illustrated in the figures, the cylinder block 10 comprises four cylinders, the parallel axes of which are identified by the letters a, b, c and d.

The cylinder block 10, in its lower part, comprises several bearings 14 which make it possible to mount a rotary shaft, in this case the engine crankshaft, the axis X—X of which is perpendicular to the axis of the cylinders 12. The bearings 14 are formed in parallel partitions 16 which extend between the cylinders and at each end of the cylinder block in planes perpendicular relative to the axis X—X of the crankshaft.

The partitions 16, at the lower end of which the bearings 14 are formed, have lateral recesses 18 which extend into the partitions in a direction parallel to the axis X—X of the crankshaft and which therefore prevent the cylinder block from being lifted in a direction parallel to the axis of cylinders 12. These recesses 18 are necessary for the machining of the base of the cylinders 12 and the inner faces of the crankshaft bearings 14 and make it possible to clear passages for the counterweights of the crankshaft. These recesses also make it possible to achieve a considerable weight saving in the production of the cylinder block.

The apparatus for the moulding of the cylinder block 10 comprises, in its upper part, four lateral mould parts 20, 22, 24 and 26 which make it possible to produce the outer wall of the cylinder block 10. The cylinders 12 are obtained by means of four cylindrical mould elements 28 arranged in the upper part of the moulding apparatus. The mould parts 20 to 28 which have just been mentioned are of conventional design and will not be described in any more detail here.

According to the invention, to carry out the moulding of the partition 16 and bearings 14, whilst making it possible to lift the cylinder block in a direction parallel to the axis of the cylinders 12, the moulding apparatus has two series of parallel moulding plates 30 and 32. When producing a block with four cylinders and five crankshaft bearings, each series of plates comprises four identical or slightly different plates. The moulding plates 30 and 32 are parallel and alternate to one another and extend in planes perpendicular relative to the axis X—X of the crankshaft.

Each of the plates 30 of the first series of plates has a moulding face 30′, in which is hollowed out a profile corresponding to the relief part of the partition 16 which delimits the bearings 14 and the recesses 18 to be produced, and an opposite bearing face 30″. In the same way, each of the plates 32 of the second series of plates comprises a moulding face 32′ matching the moulding face 30′ of the moulding plate 30 confronting it, and an opposite bearing face 32′. As can be seen in FIG. 1, the moulding faces 30′ of the plates of the first series are turned to the left, as seen in the figure, and are arranged opposite the moulding faces 32′ of the plates 32 of the second series of plates which are turned to the right.

In order to produce the wall 16 located furthest to the left, a moulding face 30′ of a plate 30 interacts with a corresponding cavity formed in the lateral mould part 20, whilst, in order to produce the partition 16 located furthest to the right, a moulding face 32′ of a plate 32 interacts with a corresponding cavity formed in the lateral mould part 22.

The four moulding plates 30 of the first series of plates are mounted on a sliding support 34. The support 34 has the form of a frame and comprises two lateral columns 36 and 38, between which the four plates 30 are mounted parallel and spaced from one another. The support 34 is mounted slidably in a horizontal stand plate 40 of the moulding apparatus, so as to be capable of sliding parallel to the axis X—X of the crankshaft in relation to the cylinder block 10. The sliding support 34 is associated with a control jack 42 which makes it possible to shift it between a closed moulding position and an open lifting position.

The four plates 32 of the second series of plates are mounted in a sliding support 44. The sliding support 44 is formed from a frame comprising two lateral columns 46 and 48, between which are mounted the four plates 32 parallel to one another and spaced at the same distance as that separating the plates 30 of the first series of plates. The support 44 is mountes slidably in a lower piece 50 of the moulding apparatus, which is fastened to the stationary stand piece 40 and in relation to which it can slide in a direction parallel to the axis X-X of the crankshaft. The sliding support 44 is likewise associated with a second control jack 43.

As shown particularly in FIG. 3, the two supports 34 and 44 are superposed and slide on one another by means of the mutually confronting surfaces of the columns 36, 38 and 46, 48 respectively. The plates 32 of the second series of plates are inserted into the corresponding spaces separating two plates 30 of the first series of plates.

According to the invention, the moulding apparatus also possesses a series of clamping elements 52 which are mounted on the platform 54 capable of sliding perpendicularly relative to the axis X—X of the crankshaft, that is to say parallel to the axis of the cylinders 12. The sliding platform 54 is mounted slidably on four pillars 56 of the stationary stand 40 and it is shifted by means of a third control jack 58.

Figure 4:
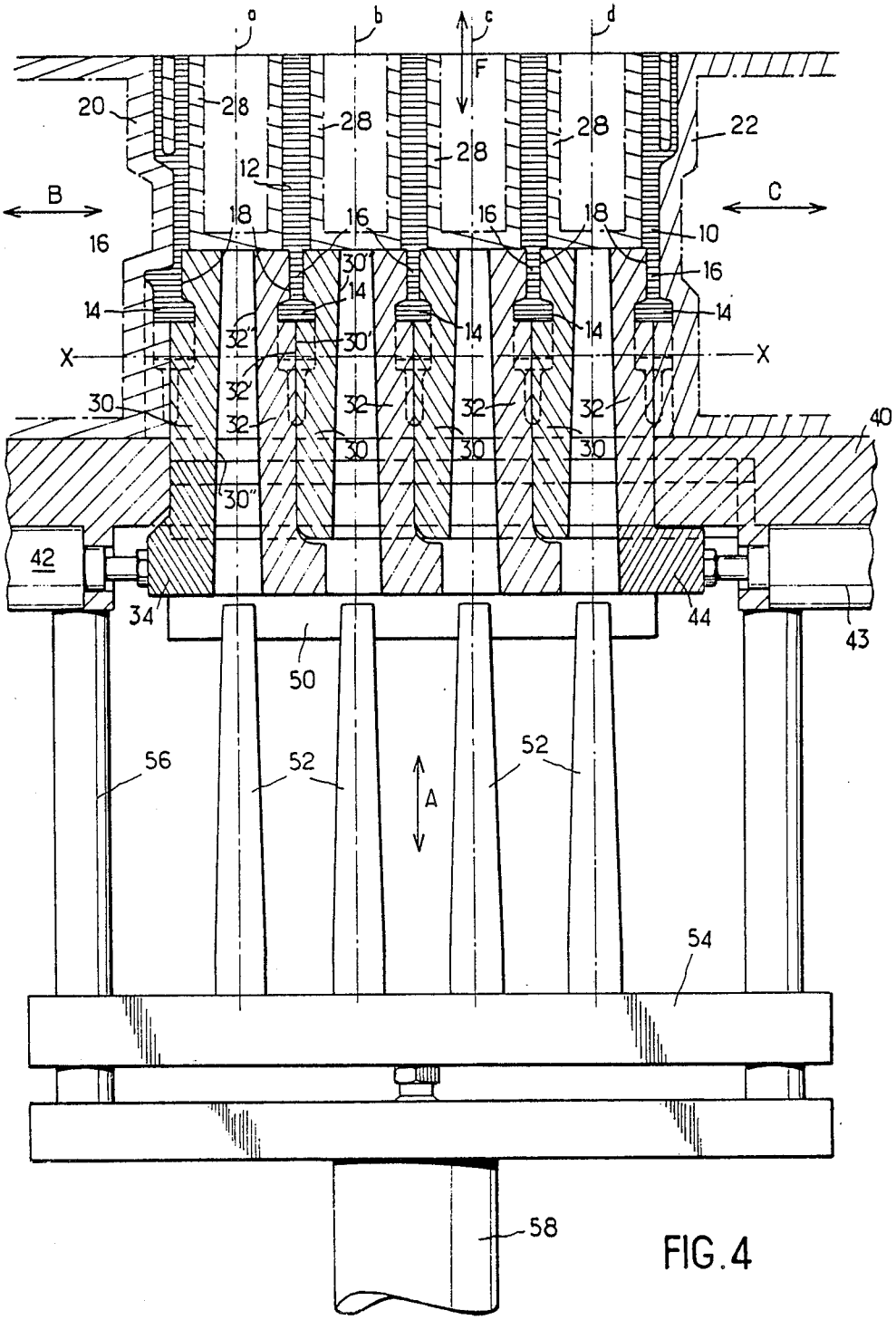
FIGS. 4 and 5 are views similar to those of FIGS. 1 and 2, in which the moulding apparatus is shown in the closed moulding position, the clamping element being in the retracted position.
Figure 6:
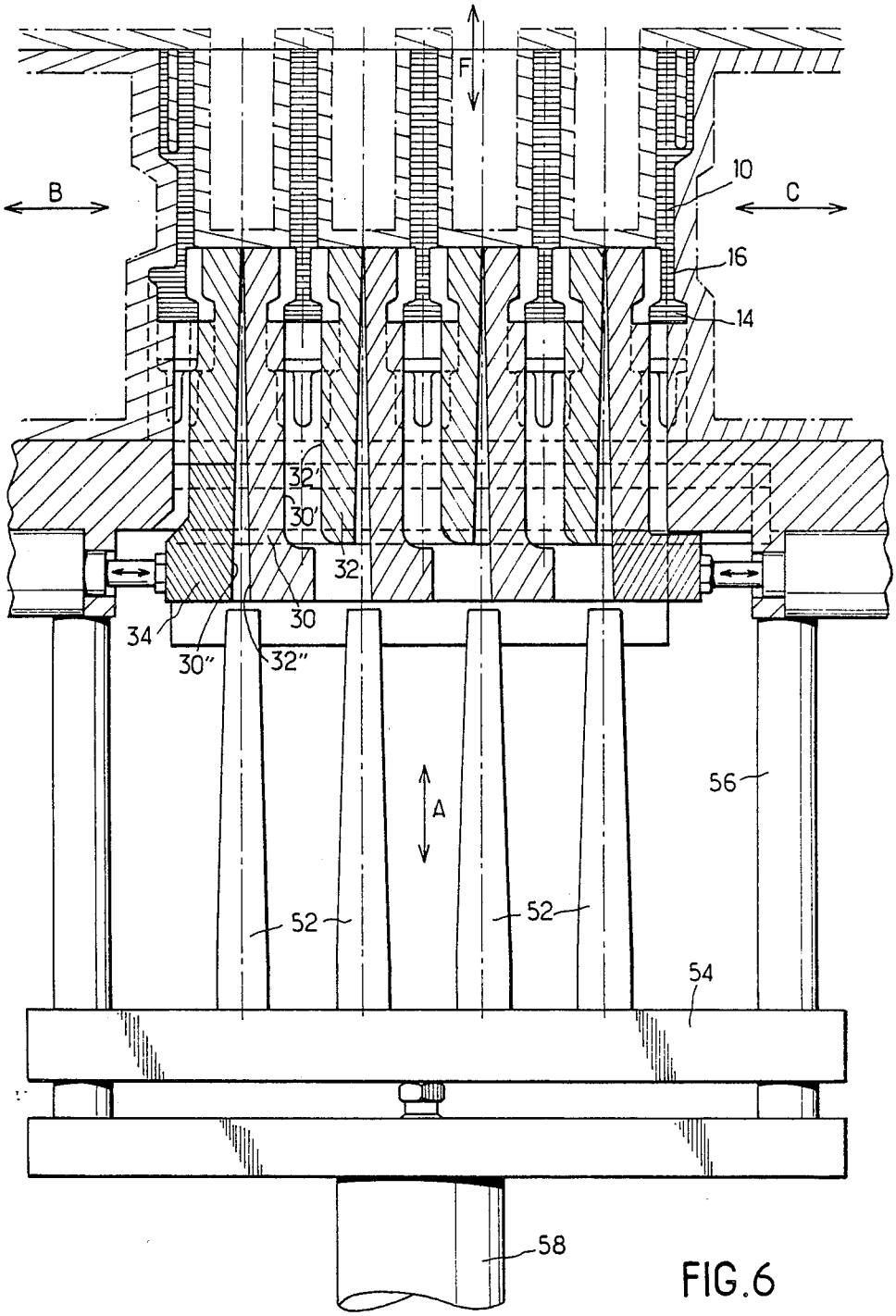
FIG. 6 is a view similar to that of FIG. 4, the moulding apparatus being shown in its open lifting position.

The clamping elements 52 consist of parallel plates which are of dimensions substantially equal to those of the plates 30 and 32, but which have, in axial section, a wedge-shaped profile, as can be seen from FIGS. 1, 4 and 6. The clamping wedges 52 extend in planes parallel to one another and are spaced at a distance substantially equal to that separating the plates of each of the two series 30 and 32.

The mode of operation of the moulding apparatus according to the invention will now be described.

Figure 2:
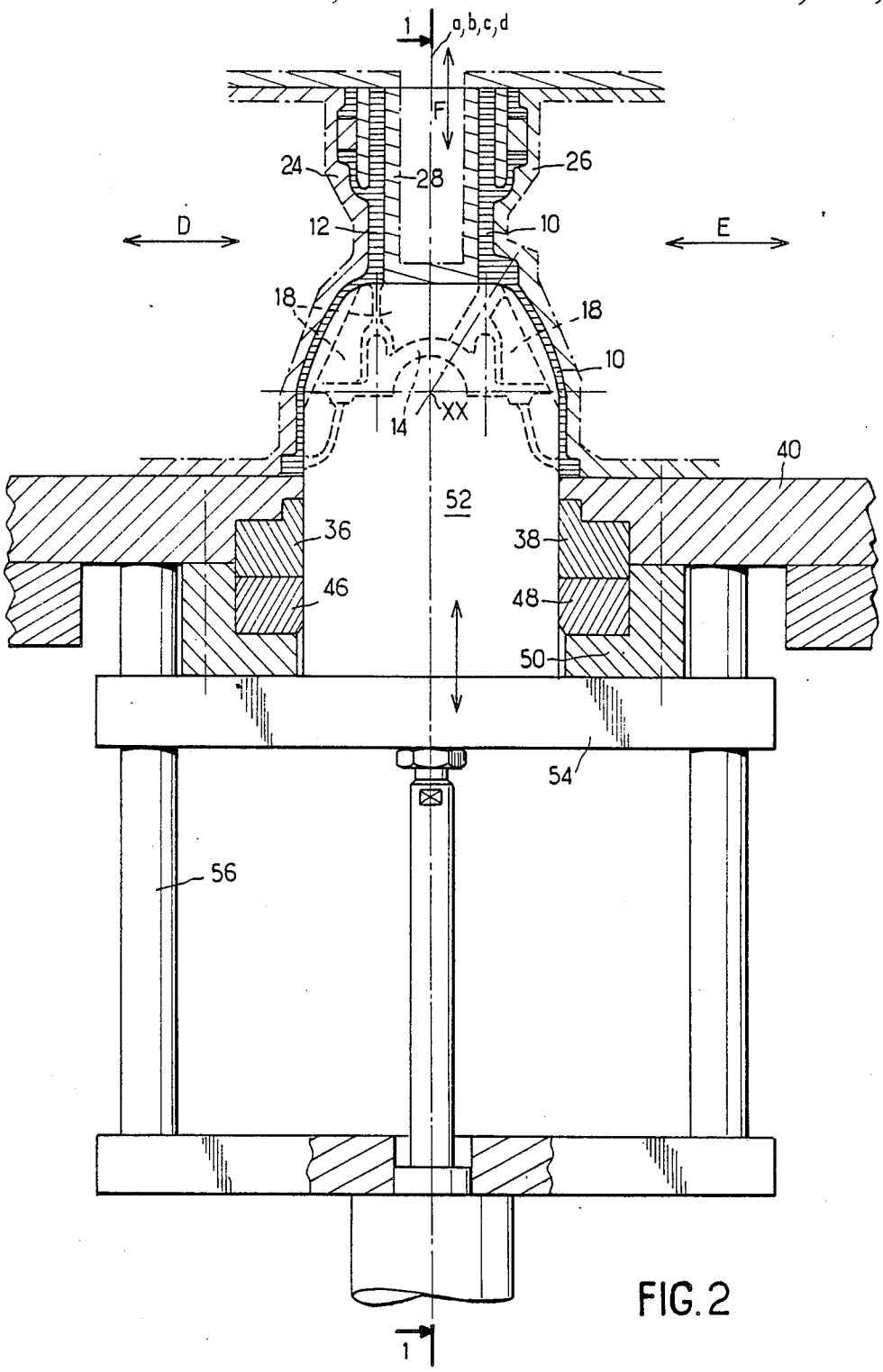
FIG. 2 is a sectional view along the line 2—2 of FIG. 1.

In FIGS. 1 and 2, the moulding apparatus is shown in its closed position, that is to say its moulding position, in which the operation of moulding the cylinder block or the corresponding foundry pattern can be carried out. In this position, the mutually confronting moulding faces 30′ and 32′ of two consecutive plates 30 and 32 bear against one another in their lower part located between the bearings 14 and the supports 34, 44.

The sliding platform 54 and the clamping wedges 52 are in their moulding position, in which each clamping element 52 is received between the mutually confronting bearing faces 30″ and 32″ of two consecutive moulding plates. Because of the wedge-shaped profile of the clamping elements 52 and the slight inclination of the bearing faces of the plates 30 and 32, the sliding platform 54 obtains an effect of clamping the moulding plates 30 and 32, so as to ensure perfect sealing of the lower part of the moulding apparatus which they form for the purpose of producing the partitions 16. Clamping takes place as a result of the vertical upward movement of the platform 54 by means of the jack 58 in the direction indicated by the arrow A.

The operation of lifting the cylinder block or the foundry pattern is carried out in several steps, starting from the moulding position shown in FIGS. 1 and 2.

Figure 5:
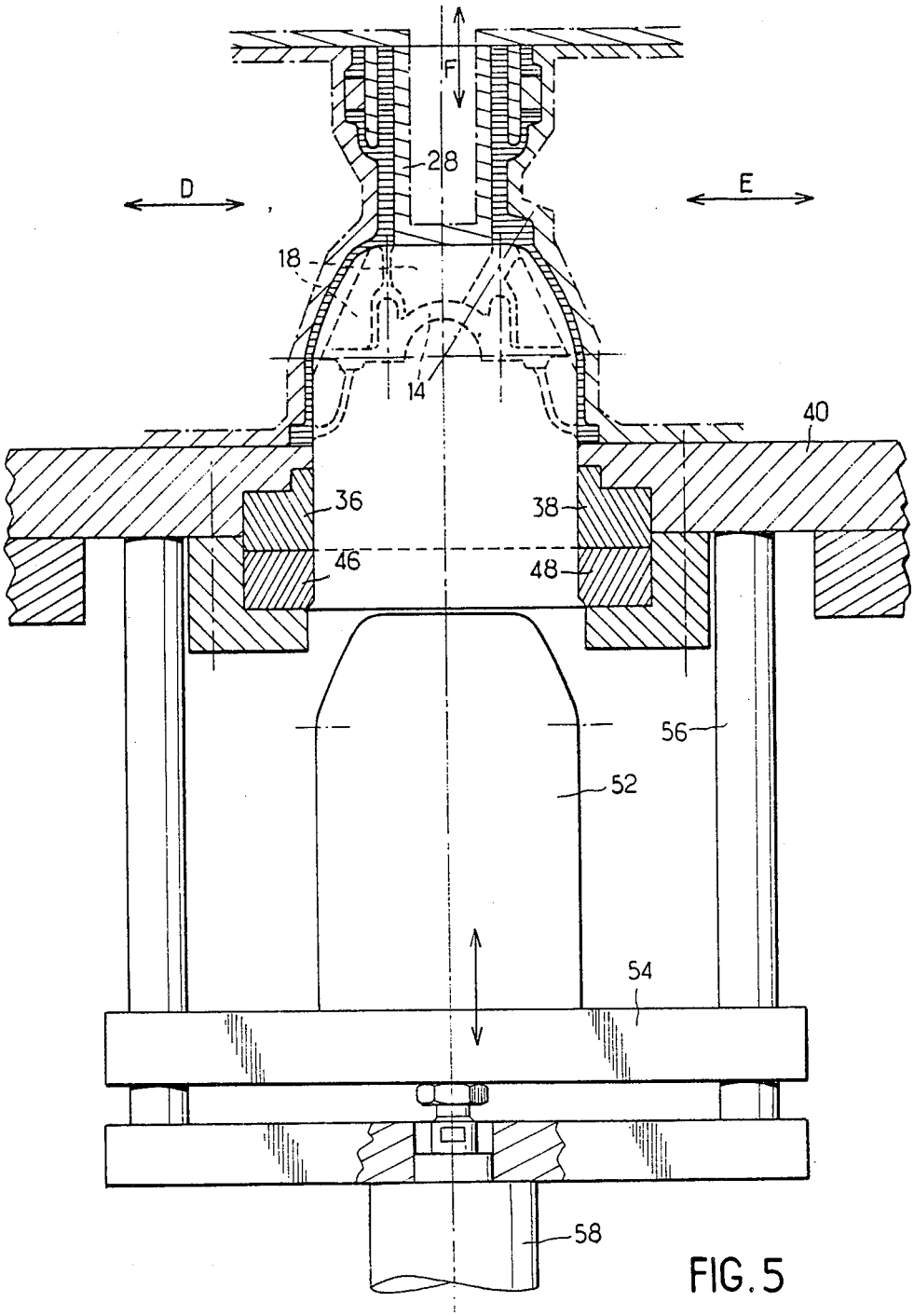

In a first step, the clamping platform 54 and therefore the clamping elements 52 are lowered vertically downwards, until the latter are retracted from between the plates 30 and 32, as illustrated in FIGS. 4 and 5. In this position, the clamping elements 52 no longer act on the plates 30 and 32, but the mutually confronting moulding faces 30′, 32′ of the latter still bear against one another as a result of the force exerted on them by the jacks 42 and 43.

During a second step, to make it possible to lift the lower part of the cylinder block 10, the two sliding supports 34 and 44 are shifted relative to one another and in relation to the cylinder block 10 by means of the two jacks 42 and 43, until the moulding apparatus is in its open lifting position shown in FIG. 6. In this lifting position, the mutually confronting bearing faces 30″ and 32" of two consecutive plates 30, 32 are in contact with one another.

As can be seen from FIG. 6, the spacing of the plates 30 and 32 is selected in such a way that, in the lifting position, the mutually confronting moulding faces 30' and 32' are sufficiently far apart from one another to allow the partitions of the cylinder block 10 to be lifted in a direction parallel to the axis of the cylinders, that is to say vertically upwards here, without any part of the plates preventing this lifting operation.

The complete lifting of the cylinder block is, of course, completed as a result of the outward movement of the upper mould parts 20 to 28 in the directions indicated by the arrows B to F.

The moulding apparatus is closed in reverse order to the steps which have just been mentioned.

I claim:

1. Apparatus for moulding a cylinder block, including several aligned cylinders with parallel axes and several bearings for mounting a rotary shaft, the axis of the shaft being perpendicular to the axes of the cylinders, several parallel partitions extending in planes perpendicular relative to the axis of the shaft for carrying the rotary shaft, the partitions having recesses preventing the cylinder block from being lifted in a direction parallel to the axis of the cylinders, wherein the moulding apparatus comprises two series of parallel and alternate moulding plates which extend in planes perpendicular relative to the axis of the shaft, each series of moulding plates being mounted respectively on a support, means for sliding the supports parallel to the axis of the shaft in relation to the cylinder block between a moulding position and a lifting position, mutually confronting moulding faces of two consecutive plates bear against one another in the moulding position, and the mutually confronting moulding faces being moved apart from one another toward the lifting position by the means for sliding of the supports.

2. Moulding apparatus according to claim 1, wherein each of the two sliding supports is connected with a control jack.

3. Moulding apparatus according to claim 1, wherein each of the two supports is formed from a frame having two lateral columns, the moulding plates are spaced from one another and positioned between the lateral column, and the two frames are superposed and slide on one another.

4. Moulding apparatus according to claim 1, further including a platform, a series of clamping elements mounted on the platform being slidable perpendicularly relative to the axis of the shaft between its moulding position, in which each clamping element is received between two consecutive plates against their bearing face opposite their moulding face, and its lifting position, in which the clamping elements are retracted in order to allow the sliding of the supports.

5. Moulding apparatus according to claim 4, wherein each clamping element consists of a wedge-shaped parallel plate extending in a corresponding plane perpendicular relative to the axis of the shaft.

6. Moulding apparatus according to claim 4, wherein the sliding platform is associated with a control jack.

* * * * *